US007103294B2

(12) United States Patent
Kawano

(10) Patent No.: US 7,103,294 B2
(45) Date of Patent: Sep. 5, 2006

(54) IMAGE FORMING APPARATUS WITH A CURRENT MEASURING SECTION

(75) Inventor: Masahiro Kawano, Tokyo (JP)

(73) Assignee: Oki Data Corporation, Tokyo (JP)

( * ) Notice: Subject to any disclaimer, the term of this patent is extended or adjusted under 35 U.S.C. 154(b) by 45 days.

(21) Appl. No.: 10/718,314

(22) Filed: Nov. 20, 2003

(65) Prior Publication Data

US 2004/0101324 A1 May 27, 2004

(30) Foreign Application Priority Data

Nov. 21, 2002 (JP) ..... 2002-338054

(51) Int. Cl.
*G03G 15/00* (2006.01)
*G03G 15/08* (2006.01)

(52) U.S. Cl. ..... 399/55; 399/281; 399/285

(58) Field of Classification Search ..... 399/46, 399/50, 53, 55, 270, 272, 281, 285; 347/140
See application file for complete search history.

(56) References Cited

U.S. PATENT DOCUMENTS

| | | | | |
|---|---|---|---|---|
| 4,603,961 A | | 8/1986 | Folkins | |
| 4,903,634 A | | 2/1990 | Ono et al. | |
| 4,947,211 A | * | 8/1990 | Ono et al. | 399/281 X |
| 5,034,775 A | * | 7/1991 | Folkins | 399/55 |
| 5,365,318 A | * | 11/1994 | Hiraoka et al. | 399/281 X |
| 5,832,350 A | * | 11/1998 | Kumasaka et al. | 399/272 X |
| 6,871,035 B1 | * | 3/2005 | Nakagawa | 399/281 |
| 2001/0026694 A1 | | 10/2001 | Sakaizawa et al. | |
| 2002/0009304 A1 | * | 1/2002 | Kin et al. | 399/55 |

FOREIGN PATENT DOCUMENTS

| | | | |
|---|---|---|---|
| JP | 53-119049 | | 10/1978 |
| JP | 62-105166 A | | 5/1987 |
| JP | 06-149029 A | * | 5/1994 |
| JP | 07-134477 | | 5/1995 |
| JP | 07-271139 A | * | 10/1995 |
| JP | 2000-206766 A | * | 7/2000 |
| JP | 2001-117367 A | * | 4/2001 |
| JP | 2002-062694 | | 2/2002 |

* cited by examiner

*Primary Examiner*—Sophia S. Chen
(74) *Attorney, Agent, or Firm*—Akin Gump Strauss Hauer & Feld, LLP

(57) ABSTRACT

An image forming apparatus operates in such a way that when the conditions of toner changes due to changes in environmental conditions, changes with age, and replacement of an EP cartridge, the bias voltages for a charging roller, a developing roller, and a toner-supplying roller are set appropriately. An electrostatic latent image can be formed on a photoconductive body. The developing roller causes developer to adhere to the electrostatic latent image to develop the electrostatic latent image. The toner-supplying roller supplies the developer to the developing roller. The current measuring section measures a current flowing through at least one of the developing roller and the toner-supplying roller. An voltage-setting section sets at least one of the developing roller and the toner-supplying roller to a corresponding one of first voltages, the first voltages being set in timed relation with development of the electrostatic latent image.

13 Claims, 8 Drawing Sheets

| SB CURRENT(μA) | ESTIMATED TONER POTENTIAL(V) |
|---|---|
| 0.5 | −350 |
| 1.0 | −270 |
| 1.5 | −240 |
| 2.0 | −200 |
| 2.5 | −160 |
| 3.0 | −130 |
| 3.5 | −70 |

| DB CURRENT($\mu$A) | BIAS VOLTAGE FOR TONER-SUPPLYING ROLLER Vs(V) |
|---|---|
| ≤2.0 | −450 |
| 2.1~8.9 | −400 |
| 9.0≤ | −350 |

IMAGE FORMING APPARATUS WITH A CURRENT MEASURING SECTION

BACKGROUND OF THE INVENTION

1. Field of the Invention

The present invention relates to an image-forming apparatus such as a printer, a facsimile machine, an electrophotographic apparatus, and a copying machine in which images are formed by controlling the bias voltages for a toner-supplying roller, a developing roller, and a charging roller.

2. Description of Related Art

FIG. 13 illustrates a general configuration of a conventional image-forming apparatus.

A charging roller 4 charges the surface of a photoconductive drum 1 to a predetermined potential. An LED head 26 illuminates the charged surface of the photoconductive drum 1 to form an electrostatic latent image on the photoconductive drum 1. A toner-supplying roller 3 delivers an appropriate amount of the toner 9, supplied from the toner cartridge 12, to developing roller 2. A toner blade 10 forms a toner layer having a uniform thickness on a developer roller 2. The developing roller 2 causes toner 9 as a developer to adhere to the electrostatic latent image formed on the photoconductive drum 1, thereby forming a toner image. A transfer roller 5 transfers the toner image formed on the photoconductive drum 1 onto a print medium 11. A cleaning roller 7 removes residual toner on the surface of the photoconductive drum 1 after transferring. For ease of maintenance, the developing roller 2 and toner-cartridge 12 are usually provided in an EP cartridge 13.

The developing roller 2, toner-supplying roller 3, and charging roller 4 receive negative voltages Vg, Vs and Ve, respectively. In this specification, these negative voltages will be described by omitting their polarity. That is, "a high voltage" means "a negative voltage having a large absolute voltage value." Likewise, "a low voltage" means "a negative voltage having a small absolute voltage value."

With the aforementioned conventional image-forming apparatus, the charging characteristic of the toner, toner-supplying roller 3, and developing roller 2 varies with environmental conditions such as temperature and humidity in a toner cartridge 12. For the same bias voltage, the amount of toner deposited to a unit area of the developing roller 2 varies greatly. Sometimes, a total amount of charge per unit area (referred to as toner potential hereinafter) in relation to the surface potential of the photoconductive drum 1 falls outside of an appropriate range.

For example, when the charging characteristic of toner is improved due to environmental changes, more toner is deposited on the developing roller 2 and the toner potential near the developing roller 2 increases as well. Toner potential is high in non-image areas on the photoconductive drum 1 where negative charges are not dissipated by exposure. Too high a toner potential may cause the toner to adhere to the non-image areas on the photoconductive drum, resulting in soiling of the print medium 11. Conversely, when the charging characteristic degrades, less toner is deposited to the developing roller 2, so that the toner potential near the developing roller 2 decreases. Thus, the toner density of an image becomes low to cause blurred print results.

In order to address variations of toner potential due to environmental conditions, the conventional image-forming apparatus has a table that lists bias voltages for the charging roller 4 and environmental conditions corresponding to the bias voltages. For various environmental conditions, suitable bias voltages for the charging roller 4 are determined experimentally. When a printing operation is performed, a bias voltage is read from the table according to environmental conditions detected with, for example, a temperature sensor and a humidity sensor.

However, with the aforementioned conventional image-forming apparatus, if the sensors are not disposed at proper locations within the EP cartridge 13, detected environmental conditions have errors, making it difficult to set appropriate bias voltages. Additionally, the charging characteristic of toner varies with time and from cartridge to cartridge. However, the same bias voltage is read from the table for the same environmental condition. Therefore, it is difficult to set optimum bias voltages.

SUMMARY OF THE INVENTION

An object of the invention is to provide an image forming apparatus in which even when the conditions of toner change due to changes in environmental conditions, changes in performance with age, and replacement of an EP cartridge, the bias voltages for the charging roller, developing roller, and toner-supplying roller are set appropriately.

An electrostatic latent image can be formed on a photoconductive body. A developing member causes developer to adhere to the electrostatic latent image to develop the electrostatic latent image. A developer-supplying member supplies the developer to the developing member. A current measuring section measures a current flowing through at least one of the developing member and the develop-supplying member. An voltage-setting section sets at least one of the developing member and the developer-supplying member to a corresponding one of first voltages, the first voltages being set in timed relation with development of the electrostatic latent image.

The current measuring section measures the current that flows through the developing member. The current is measured in at least one of a non-image forming mode where the electrostatic latent image is not formed on the photoconductive body and a solid-image forming mode where a solid electrostatic latent image is formed on a substantially entire surface the photoconductive body.

The current measuring section measures the current that flows through the developer-supplying member. The current being measured in at lest one of a non-image forming mode where the electrostatic latent image is not formed on the photoconductive body and a solid-image forming mode where a solid electrostatic latent image is formed on a substantially entire surface of the photoconductive body.

The current measuring section measures the current both in the non-image forming mode and in the solid-image forming mode.

The voltage setting section sets the corresponding one of the first voltages based on a difference in the current between the non-image forming mode and the solid-image forming mode.

The apparatus further includes a charging member that receives a second voltage from the voltage setting section and charges the photoconductive body. The current is measured in the non-image forming mode. When the current is larger than a predetermined value, the voltage setting section either increases an absolute value of the second voltage by a predetermined first value or decreases an absolute value of the corresponding one of the first voltages by a predetermined second value.

The apparatus further includes a charging member that receives a second voltage from the voltage setting section and charges the photoconductive body. The current measuring section measures a first current that flows through the developing member and a second current that flows through the developer-supplying member, the first current and the second current being measured in the non-image forming mode. When the current is larger than a predetermined value, the voltage setting section either increases an absolute value of the second voltage by a predetermined first value or decreases an absolute value of each of the first voltages by a corresponding predetermined second value.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Figure 1:
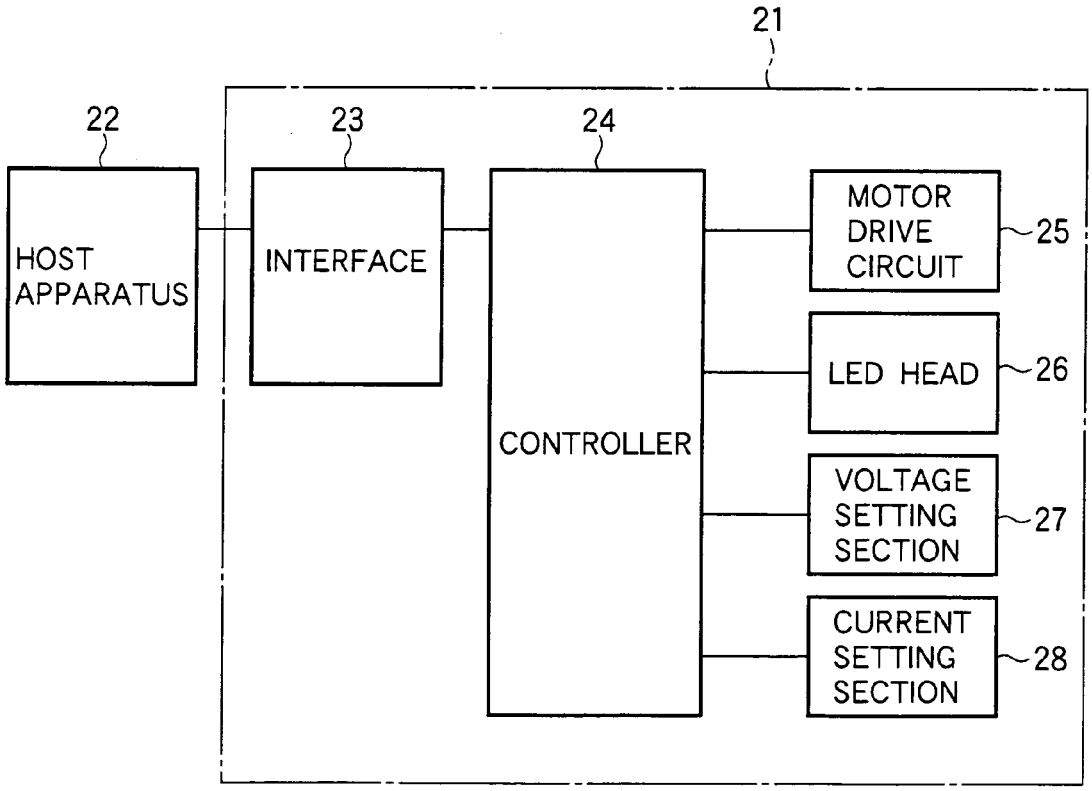
FIG. 1 is a block diagram of an image-forming apparatus according to a first embodiment.

Embodiments of the invention will be described with reference to the drawings. Like elements are given like reference numerals throughout the drawings.

FIRST EMBODIMENT

In an image forming apparatus according to a first embodiment, a toner potential is estimated based on a current supplied to a toner-supplying roller (referred to as SB current hereinafter). Then, a bias voltage for a charging roller is set based on the estimated toner potential. In other words, the surface potential on the photoconductive drum is set based on the estimated toner potential.

Construction

FIG. 1 is a block diagram of the image-forming apparatus 21 according to the first embodiment.

An interface 23 receives print data from a host apparatus 22. A controller 24 controls printing operations and a medium-transporting motor in accordance with the outputs of medium detecting sensors. A motor drive circuit 25 drives motors, not shown, in rotation, thereby controlling the transportation of print medium 11, and rotation of the rollers and photoconductive drum 1. An LED head 26 illuminates the charged surface of a photoconductive drum 1 to form an electrostatic latent image in accordance with print data such as images and characters received from a host apparatus. A voltage setting section 27 sets bias voltages for the respective rollers. A current measuring section 28 measures a current that flows through the toner-supplying roller 3.

Figure 2:
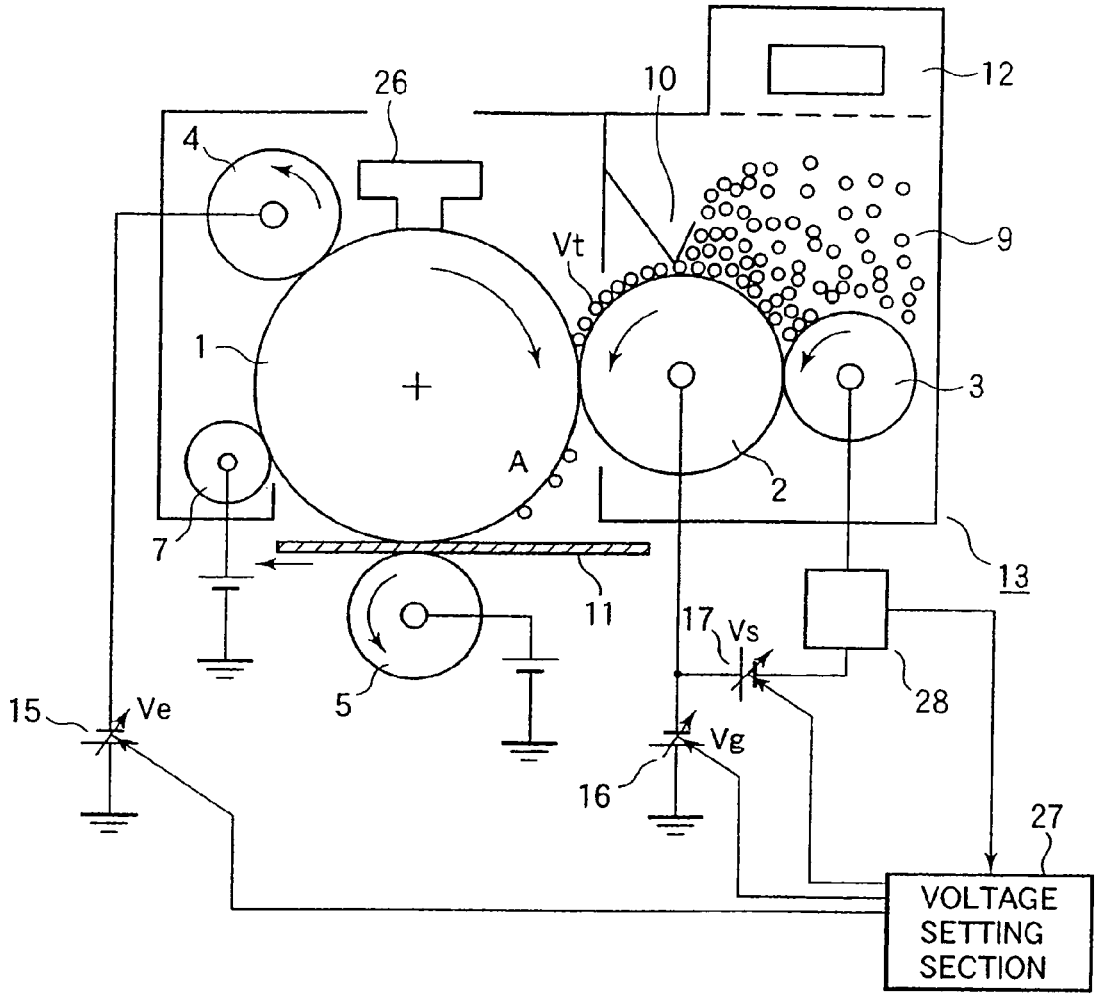
FIG. 2 illustrates a general configuration of the image-forming apparatus according to the first embodiment.

FIG. 2 illustrates a general configuration of the image-forming apparatus according to the first embodiment.

An electrostatic latent image is formed on the surface of the photoconductive drum 1. A developing roller 2 supplies toner 9 to the electrostatic latent image formed on the photoconductive drum 1. A toner-supplying roller 3 receives the toner 9 from a toner cartridge 12 and supplies the toner to the developing roller 2. A toner blade 10 forms a toner layer having a predetermined thickness on the developing roller 2. A charging roller 4 negatively charges the surface of the photoconductive drum 1 to a predetermined potential. An LED head 26 illuminates the charged surface of the photoconductive drum 1 in accordance with the print data, thereby forming an electrostatic latent image on the surface of the photoconductive drum 1. A transfer roller 5 transfers a toner image formed on the photoconductive drum 1 onto a print medium 11. A cleaning roller 7 removes residual toner remaining on the surface of the photoconductive drum 1 after transferring. The current measuring section 28 detects the current supplied to the toner-supplying rollers 3. A bias power supply 16 supplies a bias voltage to the developing roller 2 and a bias power supply 17 supplies a bias voltage to the toner-supplying roller 3. The voltage setting section 27 sets the bias voltage in accordance with the current detected by the current measuring section.

Figure 3:
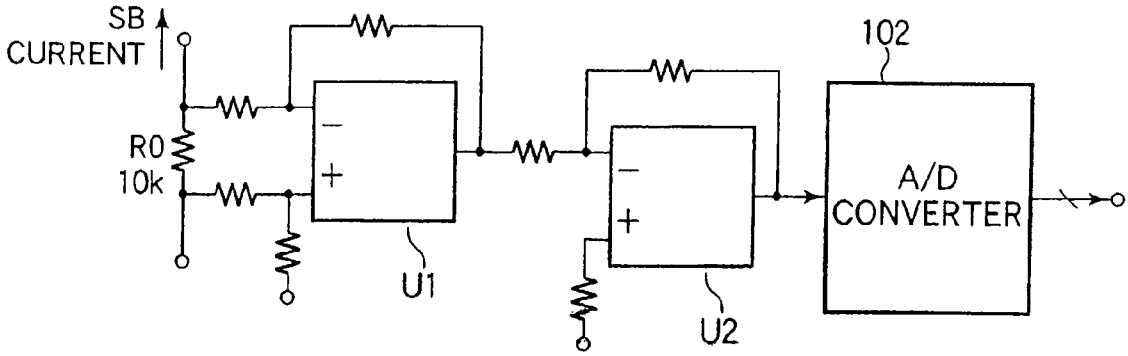
FIG. 3 illustrates a current detecting circuit according to the first to fourth embodiments.

FIG. 3 illustrates a current detecting circuit.

The SB current is measured as follows: A resistor R0, which has a relatively low resistance (usually about 10 kΩ), is inserted between the bias power supply 17 and the toner-supplying roller 3. A differential amplifier U1 having a high input impedance amplifies the voltage across the resistor R0. An amplifier U2 amplifies the output of the amplifier U1. The output of the amplifier U2 is converted by an A/D converter 102 into a digital signal and sent to the controller 24. Vref terminals of the amplifiers U1 and U2 are preferably connected to a 2.5-V constant voltage source. Alternatively, the analog output of the differential amplifier U1 may be directly input to an analog circuit that controls the output voltages of the respective bias power supplies. The current detecting circuit operates as follows: For example, a current of 1 μA creates a voltage drop of 10 mV across 10 kΩ. The differential amplifier U1 amplifies the voltage drop of 10 mV by a factor of 2. Then, the amplifier U2 amplifies the output of the amplifier U1 by a factor of 10, outputting a signal of 200 mV.

Referring back to FIG. 2, the developing roller 2, toner-supplying roller 3, and charging roller 4 receive bias voltages Vg, Vs, and Ve, respectively. The transfer roller 5 and cleaning roller 7 receive positive bias voltages. Of course, the polarity of the voltage may be reversed.

Operation

With the image-forming apparatus of the aforementioned configuration, printing is performed as follows: The toner cartridge 12 supplies the toner 9 to the toner-supplying roller 3 at appropriate times. The toner-supplying roller 3 in turn supplies the toner 9 to the developing roller 2. Then, the toner blade 10 forms a toner layer having a predetermined thickness on the developing roller 2. The LED head 26 forms an electrostatic latent image on the photoconductive drum 1. Charges in areas that represent a desired image and characters are dissipated so that the areas have a low potential. The toner 9 is deposited to the electrostatic latent image to form a toner image. The toner image is transferred onto a print medium 11 sandwiched between the photoconductive drum 1 and transfer roller 5. A fixing unit, not shown, fuses the toner image on the print medium 11 to form a permanent image.

A description will be given of bias voltages applied to the respective rollers that deliver the toner 9 in sequence.

Figure 4:
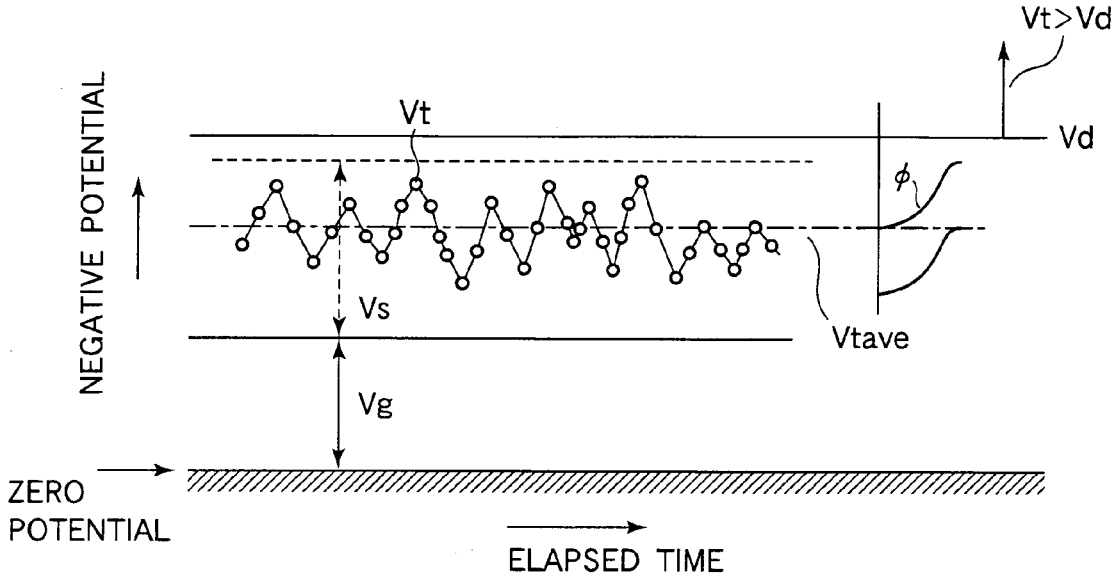
FIG. 4 illustrates the relation among potentials of toner and various bias voltages.

FIG. 4 illustrates the relation among the potential of toner and the various bias voltages.

The developing roller 2 receives a voltage from a bias power supply 16 so that the surface of the developing roller 2 is Vg. The toner 9 receives a voltage Vs from the bias power supply 17 so that the toner 9 can adhere to the developing roller 2. Usually, the toner blade 10 forms a thin layer of the toner 9 having a uniform thickness but the toner potential exhibits substantially a normal distribution ϕ centered at Vtave due to variations in thickness.

When the apparatus operates in a non-image forming mode, i.e., there is no image or character to be printed, the LED head 26 does not form an electrostatic latent image on the photoconductive drum 1. Therefore, the surface potential of the photoconductive drum 1 is a constant value Vd as shown in FIG. 4. The surface potential Vd is set to a value higher than the toner potential Vt so that the toner 9 will not migrate from the developing roller 2 to the photoconductive drum 1. A potential difference Vα of about 550 V is developed between the surfaces of charging roller 4 and photoconductive drum 1. Thus, the surface potential Vd of the photoconductive drum 1 is in the relation Vd=Ve−Vα, where Ve is the bias voltage for the charging roller. Thus, taking the potential difference Vα into account, the bias voltage Ve for the charging roller 4 is set so that Ve=Vd+Vα.

When there are images and/or characters to be formed, the LED 26 illuminates the charged surface of the photoconductive drum Vd in such a way that illuminated areas have a lower potential than Vd. As a result, the potential of the illuminated areas is lower than the toner potential Vt, so that the toner 9 adheres to the illuminated areas to form a toner image. The toner image is transferred onto the print medium 11, and then fused in the fixing unit, not shown. The positively biased cleaning roller 7 attracts the toner remaining on the photoconductive drum 1 after transfer of the toner image, thereby performing a cleaning operation for the photoconductive drum 1.

Figure 5:
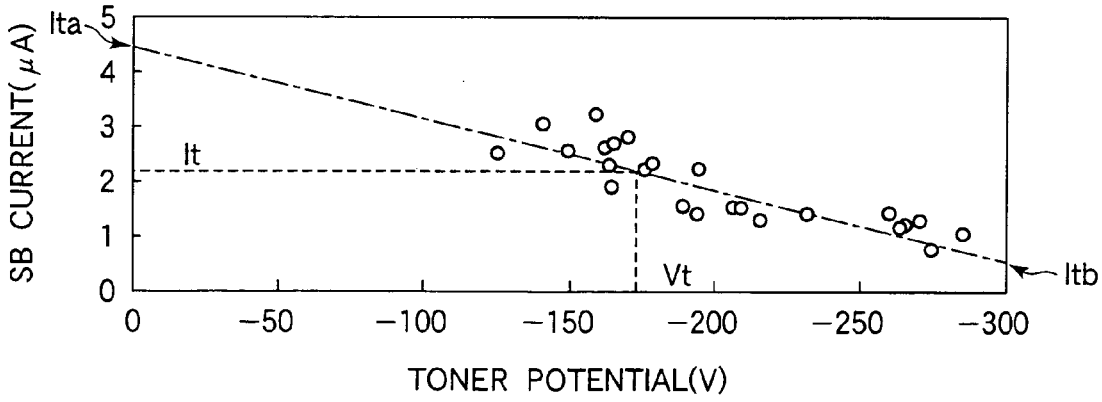
FIG. 5 is a graph, illustrating SB currents supplied to a toner-supplying roller and corresponding toner potentials surrounding a developing roller.

FIG. 5 illustrates SB currents supplied to the toner-supplying roller 3 and corresponding potentials Vt of toner surrounding the developing roller 2.

The SB currents are measured for different amounts of toner in a toner layer formed on the developing roller 2. When the apparatus operates in the non-image forming mode, the amount of toner on the developing roller 2 is changed by adjusting the bias voltage Vg for the developing roller 2 or the bias voltage Vs for the toner-supplying roller 3. The toner potential near the developing roller 2 was measured in a Kelvin probe method by using a surface potential measuring instrument.

As is clear from FIG. 5, the higher the toner potential, the smaller the SB current. This implies that the larger the amount of toner in a layer formed on the developing roller, the higher the toner potential Vt. Because the thickness of the toner layer between the toner-supplying roller 3 and developing roller 2 increases at a higher rate than the toner potential, the toner layer has a larger resistance and therefore the SB current decreases.

Thus, in the first embodiment, the SB current in the non-image forming mode is used to estimate the toner potential of the developing roller 2, thereby setting the surface potential Vd of the photoconductive drum 1 based on the estimated toner potential.

The relation between the SB currents It and the toner potentials Vt is linearly approximated as plotted by a dotted line in FIG. 5. The relation is given by $$It=Ita-Vt\times(Ita-Itb)*/300 \quad \text{Eq. (1)}$$

where Ita is an SB current when Vt=0 and Itb is an SB current when Vt=−300V.

Thus, the following relation is derived.

$$Vt=300\times(Ita-It)/(Ita-Itb) \quad \text{Eq. (2)}$$

This implies that the toner potential Vt near the developing roller 2 can be estimated by measuring the SB current It.

In the first embodiment, for example, the SB current It is measured prior to a printing operation, and an average Itave of the SB current is calculated, thereby calculating an average toner potential Vtave using Eq. (2).

The average value Vtave of toner potential is determined as follows: Ita, Itb, and a voltage (e.g., −300V in this embodiment) corresponding to Itb are stored in a memory of the controller 24. The average value of It=Itave is calculated by Eq. (1) and thus Vtave can be derived from Itave by Eq. (2).

Figures 6, 7:
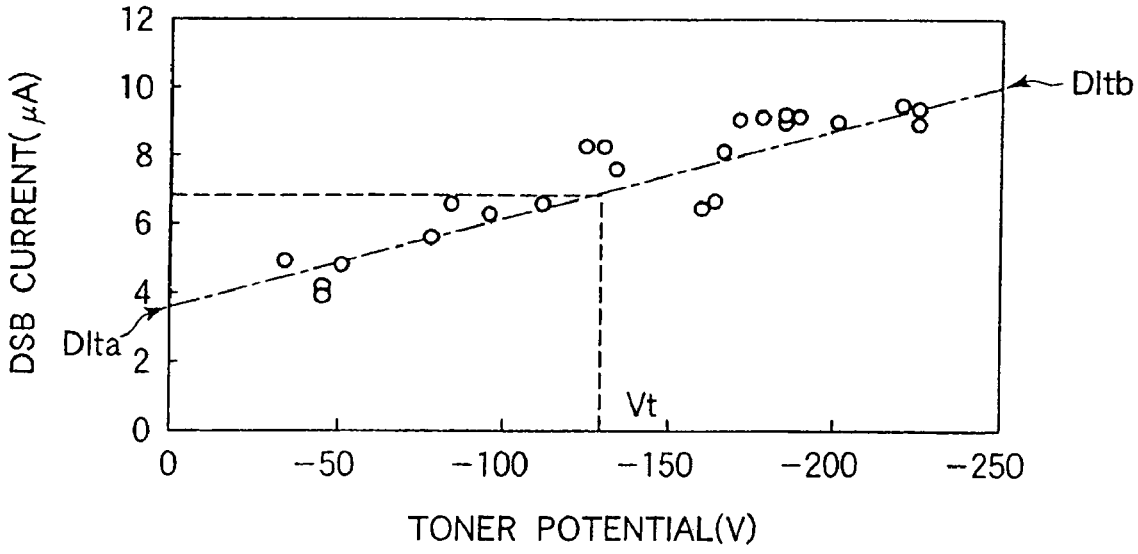
FIG. 6 is a table that lists the relation between the SB currents and corresponding toner potentials in the first embodiment.
FIG. 7 illustrates the relation between DSB currents and the toner potentials in a second embodiment.

FIG. 6 is a table that lists the relation between the SB currents and corresponding toner potentials in the first embodiment.

Instead of calculating the Vtave, a table of the SB currents and corresponding estimated toner potentials may be stored in the memory of the controller 24. Then, the average value Vtave corresponding to the average value Itave can be read from the memory. For example, if the average value of Itave is 2.5 μA, an estimated toner potential is −160 V. If the average value of Itave is 2.25 μA, then a linear interpolation is performed to obtain Vtave based on the estimated toner potential of −200 V for 2.0 μA and the estimated toner potential of −160 V for 2.5 μA, the estimated toner potential being between −200 V and −160 V. Thus, the average value Vtave of the estimated toner potential is −180 V. Still alternatively, the relation between the SB currents It and the toner potentials Vt may be approximated by dividing the entire relation into a plurality of straight lines, though this is a somewhat time-consuming operation. The average value Vtave of toner potential can be estimated from the approximated equations.

The surface potential Vd of the photoconductive drum 1 is set to a value equal to the sum of Vtave, Vg, and Va (Va is about −300 V as a rule of thumb). Taking the potential difference Vα between the photoconductive drum 1 and the charging roller 4 into account, the bias voltage Ve for the charging roller 4 is set by Eq. (3) and Eq. (4) as follows:

$$Ve=Vd+V\alpha \quad \text{Eq. (3)}$$

$$Vd=Vg+Vtave+Va \quad \text{Eq. (4)}$$

where Vα is about −550 V, i.e., a voltage above which electrical discharge occurs between the charging roller 4 and the photoconductive drum 1. For example, when the estimated toner potential is −150 V, Vd=(−300)+(−150)+(−300)=−750 assuming that the developing bias is Vg=−300 V. Thus, the bias voltage Ve for the charging roller 4 is Ve=(−750)+(−550)=−1300 V.

As described above, the toner potential is estimated from the SB current It supplied to the toner-supplying roller 3. Then, the surface potential Vd of the photoconductive drum 1 is set based on the estimated toner potential. This way of setting the surface potential Vd prevents not only soiling of the printed Image that would other wise occur when the surface potential Vd is lowered excessively, but also blurring of the printed image that would otherwise occur when the surface potential Vd is raised excessively.

As described above, the toner potential Vt can be accurately estimated even if the amount of toner in a toner layer formed on the developing roller 2 changes due to changes in environmental conditions, changes in performance over time, and changes in charging characteristic due to replacement of the EP cartridge 13. This allows accurate setting of the surface potential Vd of the photoconductive drum 1 and therefore prevents non-image areas on the print medium from being soiled as well as blurring of the printed images due to decreased toner density.

SECOND EMBODIMENT

In the first embodiment, when the apparatus operates in the non-image forming mode, the SB current is measured and the toner potential is estimated on the basis of the measured SB current. Then, the bias voltage Ve of the charging roller 4 is set based on the estimated toner potential. However, because the SB currents are very small, measured SB currents involve errors due to the measurement errors of the current measuring section 28. Such errors come from variations of the operational amplifiers including drift with temperature and offset. Therefore, when the bias voltage Ve of the charging roller 4 needs to be accurately set, it is necessary to employ expensive devices that are immune to environmental charges and have very small manufacturing variations.

An image-forming apparatus according to a second embodiment has the following features. The SB current during the development of an electrostatic latent image is measured both in the non-image forming mode and in a solid image forming mode where the LED head 26 illuminates the entire surface of the photoconductive drum 1. Then, the toner potential is estimated based on the difference between the SB currents in the aforementioned two modes. The second embodiment eliminates the use of expensive components while also allowing accurate, appropriate setting of the surface potential Vd of the photoconductive drum 1.

The image forming apparatus according to the second embodiment has the same general construction as the first embodiment and therefore the description thereof is omitted.

Just as in the first embodiment, for different amounts of toner in a toner layer formed on the developing roller, SB current is measured both in the non-image forming mode and in the solid image forming mode. Then, the difference (referred to as DSB current hereinafter) in SB current between these two modes are calculated.

FIG. 7 illustrates the relation between DSB currents and corresponding toner potentials.

When an electrostatic latent image occupies only very limited areas on the surface of the photoconductive drum 1, only a small amount of the toner 9 on the developing roller 2 migrates to the photoconductive drum 1. Thus, a large amount of the toner 9 exists between the toner-supplying roller 3 and the developing roller 2, so that the SB current is small. When a solid electrostatic latent image is formed on the photoconductive drum, most of the toner 9 on the developing roller 2 migrates to the photoconductive drum 1 and only a small amount of toner 9 exists between the toner-supplying roller 3 and the developing roller 2. Thus, the SB current is large. The DSB current is the difference between the aforementioned small SB current and large SB current.

Referring to FIG. 7, it can be said that the higher the toner potential, the larger the DSB current.

This is due to the following fact. When no electrostatic latent image is formed, the DSB decreases with increasing toner potential, but the rate of increase of the SB current when a solid electrostatic latent image is formed is higher than the rate of decrease of the SB current when the no electrostatic latent image is formed.

In other words, when a solid electrostatic latent image is formed, more toner migrates to the photoconductive drum 1, causing rapid increase of the charged toner 9 that migrates from the toner-supplying rollers 3 through the developing roller 2 to the photoconductive drum 1. As a result, the SB current increases rapidly.

In the second embodiment, the DSB current is used to estimate the toner potential near the developing roller 2, thereby setting the surface potential Vd of the photoconductive drum 1 in the following manner.

The relation between the DSB current DIt and the toner potential Vt is approximated as shown in a dotted line in FIG. 7. The toner potential Vt is expressed in terms of DIt as follows:

$$DIt=Vt\times(DItb-DIta)/250+DIta \quad \text{Eq. (5)}$$

where DIta is a DSB current when the toner potential is Vt=0 and DItb is a DSB current when the toner potential is Vt=250 V.

Therefore, Vt is obtained by $$Vt=250\times(DIt-DIta)/(DItb-DIta) \quad \text{Eq. (6)}$$

Thus, by measuring DIt, the toner potential Vt on the developing roller 2 can be estimated.

In the second embodiment, the DIt is measured, for example, prior to printing and an average DSB current DItave is calculated. The average toner potential Vtave' is calculated using Eq. (6).

The DIta, DItb, and a voltage (e.g., 250 V in this embodiment) corresponding to DItb are stored in a memory of the controller 24. By inputting DItave into the term DIt of Eq.

(6), the average value Vtave' of toner can be calculated. Alternatively, the DSB currents and corresponding estimated toner potentials Vt are stored in the memory of the controller 24 and then an average value Vtave' of toner potential corresponding to DItave is read. Still alternatively, the relation between the DSB currents DIt and the toner potentials Vt may be approximated by dividing the entire relation between DIt and Vt into a plurality of straight lines, though this is a somewhat time-consuming operation. Then, the average value Vtave' of toner potential can be estimated from the approximated equations.

The surface potential Vd of the photoconductive drum 1 is set to a value equal to the sum of Vtave', Vg, and Va (about −300 V as a rule of thumb). Taking the potential difference Vα between the photoconductive drum 1 and the charging roller 4, the bias voltage Ve for the charging roller 4 is set by Eq. (7) and Eq. (8) as follows:

$$Ve=Vd+V\alpha \quad \text{Eq. (7)}$$

$$Vd=Vg+Vtave'+V\alpha \quad \text{Eq. (8)}$$

As described above, the toner potential is estimated from the DSB current DIt supplied to the toner-supplying roller 3. Then, the surface potential Vd of the photoconductive drum 1 is set based on the estimated toner potential. This way of setting the surface potential Vd prevents not only soiling of the printed images that would otherwise occur when the surface potential Vd is lowered excessively, but also blurring of the printed images that would otherwise occur when the surface potential Vd is raised excessively.

When the apparatus operates in the solid image forming mode is formed and in the non-image forming mode, environmental conditions can change with time. Therefore, the SB currents are preferably measured at close timings and immediately before a printing operation. For example, when no print medium 11 has not been fed between the photoconductive drum 1 and transfer roller 5 yet, the image forming apparatus should operate in the solid image-forming mode and then in the non-image forming mode, or vice versa, thereby measuring SB currents in the respective modes.

As described above, the toner potential is estimated based on the DSB current, which is the difference DSB in SB current between the solid-image forming mode and the non-image forming mode. In this manner, errors due to offset and temperature drift of the current measuring section 28 are cancelled out, so that estimation of toner potential can be accurately performed. The DSB current in the second embodiment in FIG. 7 is larger than that in the first embodiment in FIG. 5. This indicates that estimation of toner potential based on the DSB current in the second embodiment is more accurate than that based on the SB current in the first embodiment.

As described above, the toner potential is estimated based on the DSB current, i.e., the difference in SB current between the solid-image forming mode and the non-image forming mode. Thus, in addition to the first embodiment, highly accurate estimation of toner potential can be made without the need for expensive components for measuring the SB currents, and an accurate, appropriate surface potential Vd of the photoconductive drum 1 can be set.

THIRD EMBODIMENT

A third embodiment has the feature that when an SB current larger than a predetermined value is detected, the bias voltage Ve for the charging roller 4 is corrected based on the detected SB current.

An image forming apparatus according to the third embodiment has the same general construction as the first embodiment and therefore the description thereof is omitted.

Figure 8:
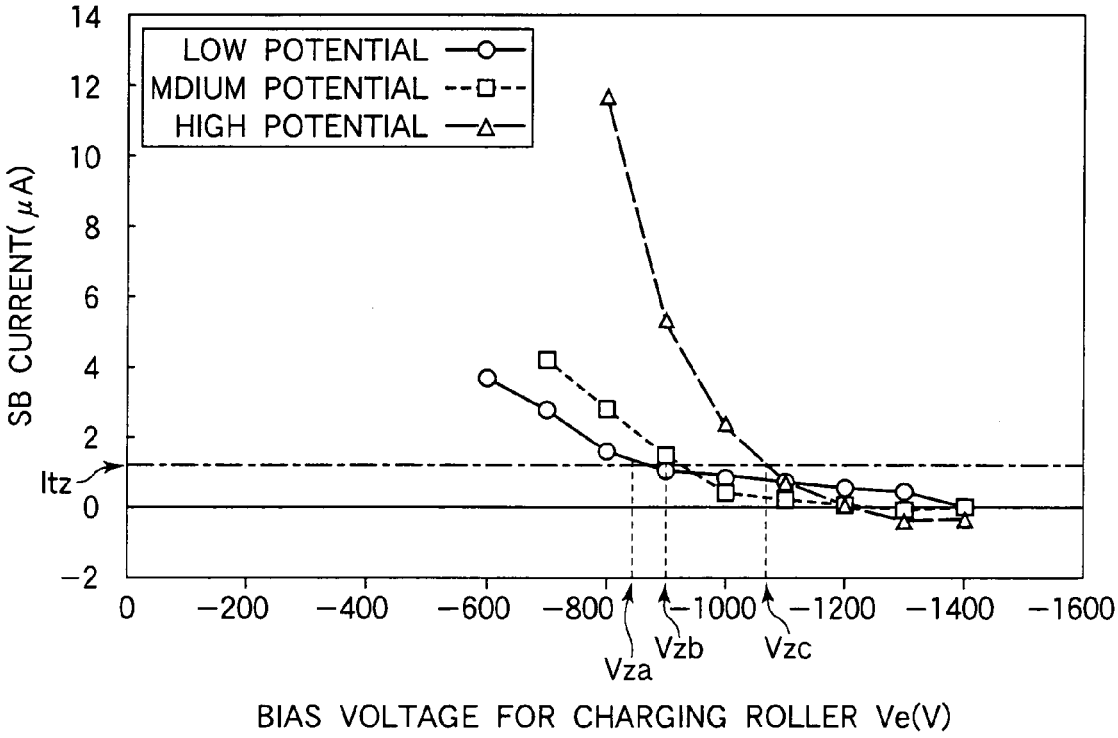
FIG. 8 shows a third embodiment, illuminating the relation between the bias voltages for the charging roller and the SB currents for different toner potentials.

FIG. 8 illuminates the relation between the bias voltage Ve for the charging roller 4 and the SB current for different toner potentials.

As is clear from FIG. 8, the SB current rapidly increases for the bias voltages Ve lower than a certain bias voltage. For example, when the toner potential is high, if the bias voltage Ve is lowered below Vzc, the SB current rapidly increases from Itz. Likewise, when the toner potential is medium, if the bias voltage Ve is lowered below Vzb, the SB current rapidly increases from Itz. When the toner potential is low, if the bias Ve for the charging roller 4 is lowered below Vza, the SB current rapidly increases from Itz. The SB currents larger than Itz cause the soiling of the non-image areas on the printed medium.

This is due to the following facts. When the toner potential Vt becomes higher than the surface potential Vd of the photoconductive drum 1, the toner begins to adhere to non-image areas of the photoconductive drum 1 and is then transferred onto the print medium 11. Thus, the toner 9 begins to migrate to the developing roller 2. This is also clear from the fact that the Vz becomes low with decreasing toner potential.

By using the aforementioned characteristic, when the SB current exceeds a predetermined current Itz, the bias voltage Ve is increased by a predetermined voltage value. In other words, Ve is given by $$Ve=Ve'+Va$$

where Ve' is the bias voltage for the charging roller 4 before correction. The appropriate value of Va is about −300 V. Instead of detecting the SB current larger than Itz, the bias Ve may be corrected by feeding back through a negative feedback loop the SB current larger than Itz to the bias power supply 15 that supplies a bias voltage to the charging roller 4.

In the third embodiment, the SB current is monitored. When the SB current exceeds a predetermined value, the bias voltage Ve for the charging roller 4 is corrected. This way of controlling the bias voltage Ve ensures the prevention of soling of non-image areas on the print medium.

FOURTH EMBODIMENT

Figure 9:
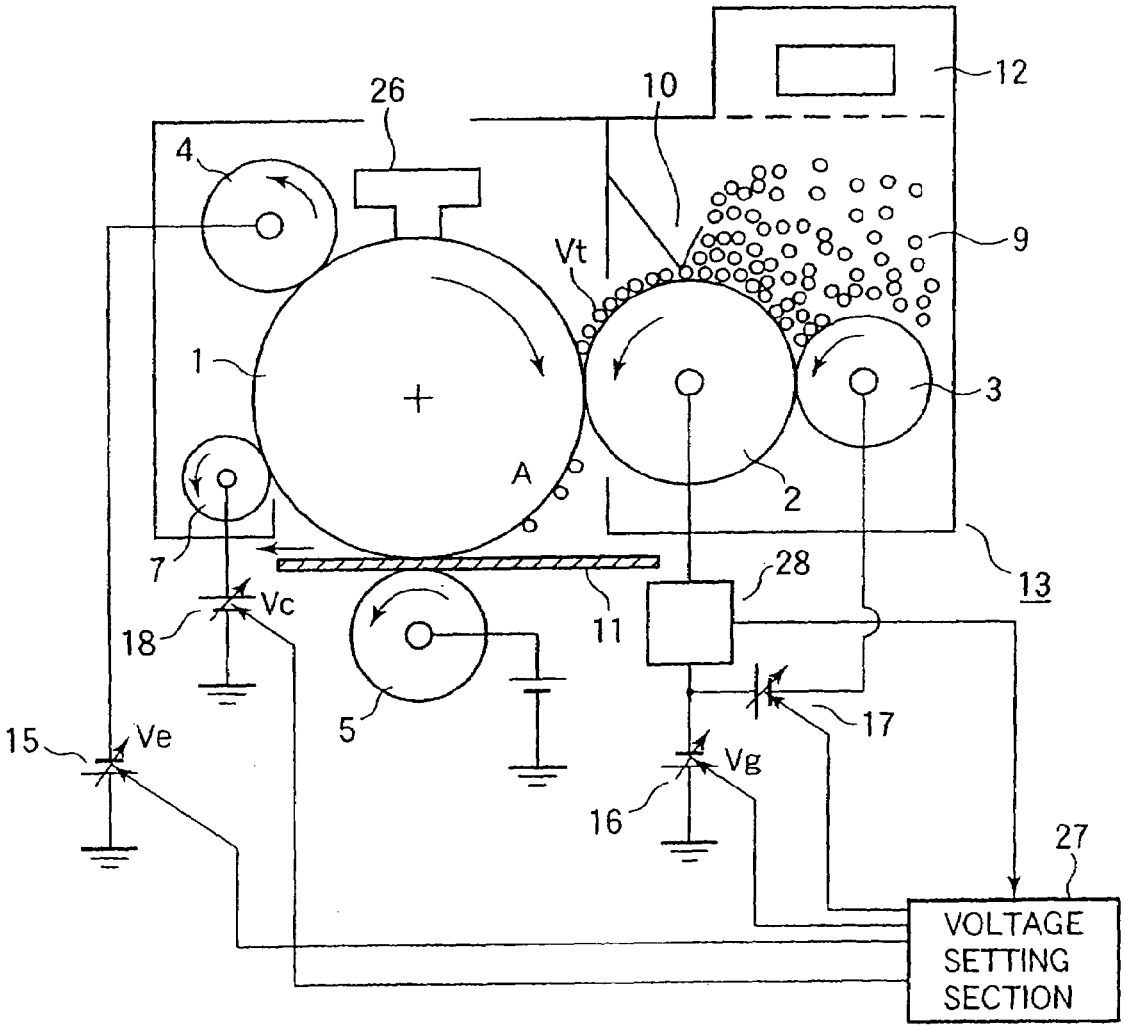
FIG. 9 illustrates a general configuration of the image-forming apparatus according to a fourth embodiment and a fifth embodiment.

FIG. 9 illustrates a general configuration of the image-forming apparatus according to a fourth embodiment.

The fourth embodiment has the feature that a toner potential is estimated based on a current (referred to as DB current) supplied to the developing roller 2 and a bias voltage for the charging roller 4 is set based on the estimated toner potential.

The fourth embodiment has the same general construction as the first embodiment and differs from the first embodiment only in the connection of the current measuring section 28. For simplicity's sake, only a configuration different from the first embodiment will be described.

With the first to third embodiments, the toner potential is estimated based on the SB current supplied to the toner-supplying roller 3. In the fourth embodiment, the toner potential is estimated based on the DB current that is supplied to the developing roller 2 when the toner migrates from the developing roller 2 to the photoconductive drum 1. For this reason, the current measuring section 28 is inserted between the bias power supply 16 and the developing roller 2. The values of DB current are substantially in the same range as the SB current and DSB current. Therefore, a DB current measuring circuit for the current measuring section 28 may be of the same configuration in FIG. 3.

Operation

An image-forming apparatus according to the fourth embodiment operates in the same manner as that according to the first embodiment. The potentials at the various locations are also the same as those in the first embodiment in FIG. 4. Thus, the description of the image-forming apparatus will be omitted for simplicity's sake.

Usually, the DB current is relatively small in the non-image forming mode because a large amount of toner 9 does not migrate to the photoconductive drum 1 and a large amount of toner 9 exists between the developing roller 2 and photoconductive drum 1. The DB current is relatively large in the solid-image forming mode because most of the toner 9 on the developing roller 2 migrates to the photoconductive drum 1 and only a small amount of toner 9 exists between the developing roller 2 and photoconductive drum 1.

Figure 10:
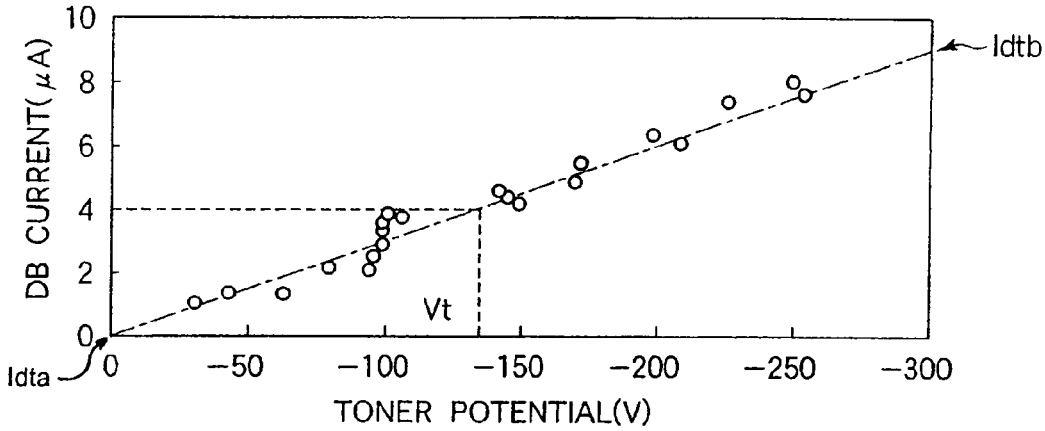
FIG. 10 is a graph in the fourth embodiment, illustrating the relation between the DB currents and corresponding toner potentials in the solid-image forming mode.

FIG. 10 illustrates the relation between the DB currents and corresponding toner potentials in the solid-image forming mode.

Referring to FIG. 10, it can be said that the higher the toner potential, the larger the DB current. This is because when the toner potential increases, more toner migrates to the photoconductive drum 1 and the DB current increases accordingly.

In the fourth embodiment, the DSB current in the solid-image forming mode is used to estimate the toner potential near the developing roller 2, thereby setting the surface potential Vd of the photoconductive drum 1 in the following manner.

The relation between the DSB current Idt and the toner potential Vt is approximated depicted in a dotted line in FIG. 10. The toner potential Vt is expressed in terms of Idt as follows:

$$Idt=Vt\times(Idtb-Idta)/300+Idta \quad \text{Eq. (9)}$$

where Idta is a DB current when Vt=0, and Idtb is a DB current when Vt is 300 V. Therefore, Vt is obtained by $$Vt=300-(Idt-Idta)/(Idtb-Idta) \quad \text{Eq. (10)}$$

Thus, the toner potential Vt on the developing roller 2 can be estimated by measuring the DB current Idt.

In the fourth embodiment, the DB current Idt is measured, for example, prior to a printing operation, and then an average value Idtave of DSB currents is calculated. The average toner potential Vtave is then calculated using Eq. (10).

The Idta, Idtb, and a voltage (e.g, 300 V in the embodiment) corresponding to Idtb are stored in a memory of the controller 24. By inputting Idtave into the term Idt in Eq. (10), the average value Vtave of toner potential can be calculated. Alternatively, the DSB currents and corresponding estimated toner potentials Vt are stored in the memory of the controller 24 so that the average value Vtave of toner potential corresponding to the average value Idtave can be read from the memory. Still alternatively, the relation between the DB currents Idt and the toner potentials Vt is approximated by dividing the entire relation of Idt and Vt into a plurality of straight lines, though this is a somewhat time-consuming operation. Then, the average value Vtave of toner potential can be estimated from the approximated equations.

The surface potential Vd of the photoconductive drum 1 is set to a value equal to the sum of Vtave, Vg, and Va (about −300 V as a rule of thumb). Taking the potential difference Vα (=−550 V) between the photoconductive drum 1 and the charging roller 4 into consideration, the bias voltage Ve for the charging roller 4 is set by Eq. (11) and Eq. (12) as follows:

$$Ve=Vd+V\alpha \quad \text{Eq. (11)}$$

$$Vd=Vg+Vtave+Va \quad \text{Eq. (12)}$$

As described above, the toner potential is estimated from the DSB current Idt supplied to the toner-supplying roller 3. Then, the surface potential Vd of the photoconductive drum 1 is set based on the estimated toner potential. This way of setting the surface potential Vd prevents not only soiling of the printed image that would otherwise occur when the surface potential Vd is lowered excessively, but also blurring of the printed image that would otherwise occur when the surface potential Vd is raised excessively.

Environmental conditions can change with time. Therefore, just as in the other embodiments, when the apparatus operates in the solid-image forming mode, the DB currents are preferably measured immediately before a printing operation.

As described above, the toner potential is not estimated based on the DB current in the solid-image forming mode. That is, the DB current was measured both in the non-image forming mode and in the solid-image forming mode and the difference in DB current between the two modes is calculated as a DDB current. Then, the relation between the DDB currents and corresponding toner potentials Vt similar to that in FIG. 7 is determined, so that the toner potential can be estimated accurately from the DDB current during developing.

As described above, according to the fourth embodiment, the toner potential can be accurately estimated even if the amount of toner in a toner layer formed on the developing roller 2 changes due to changes in environmental conditions, changes in performance over time, and changes in charging characteristic due to replacement of the EP cartridge 13. This allows accurate setting of the surface potential Vd of the photoconductive drum 1 and therefore prevents soiling of non-image areas on the print medium, and blurring of print images due to decreased toner density.

FIFTH EMBODIMENT

In the second embodiment, the SB current is measured in the solid-image forming mode. In the fourth embodiment, the DB current is measured in the solid-image forming mode. The fifth embodiment has the feature that a toner collecting means is provided for collecting toner used in the solid-image forming mode performed in the second and fourth embodiments.

The general configuration of the image-forming apparatus according to a fifth embodiment is the same as that in FIG. 9. As shown in FIG. 9, an image-forming apparatus according to the fifth embodiment is configured such that a bias voltage Vc of the cleaning roller 7 can be controlled. In other words, the output of the voltage setting section 27 is connected not only to the bias power supply 15, bias power supply 16, and bias power supply 17 but also to a bias power supply 18 for the cleaning roller 7. The rest of the construction is the same as other embodiments.

Operation

A large amount of toner is used when the SB current and DB current are measured in the solid-image forming mode. The image forming-apparatus of the aforementioned structure operates in such a way that a large amount of toner is not accumulated on the cleaning roller 7.

Figure 11:
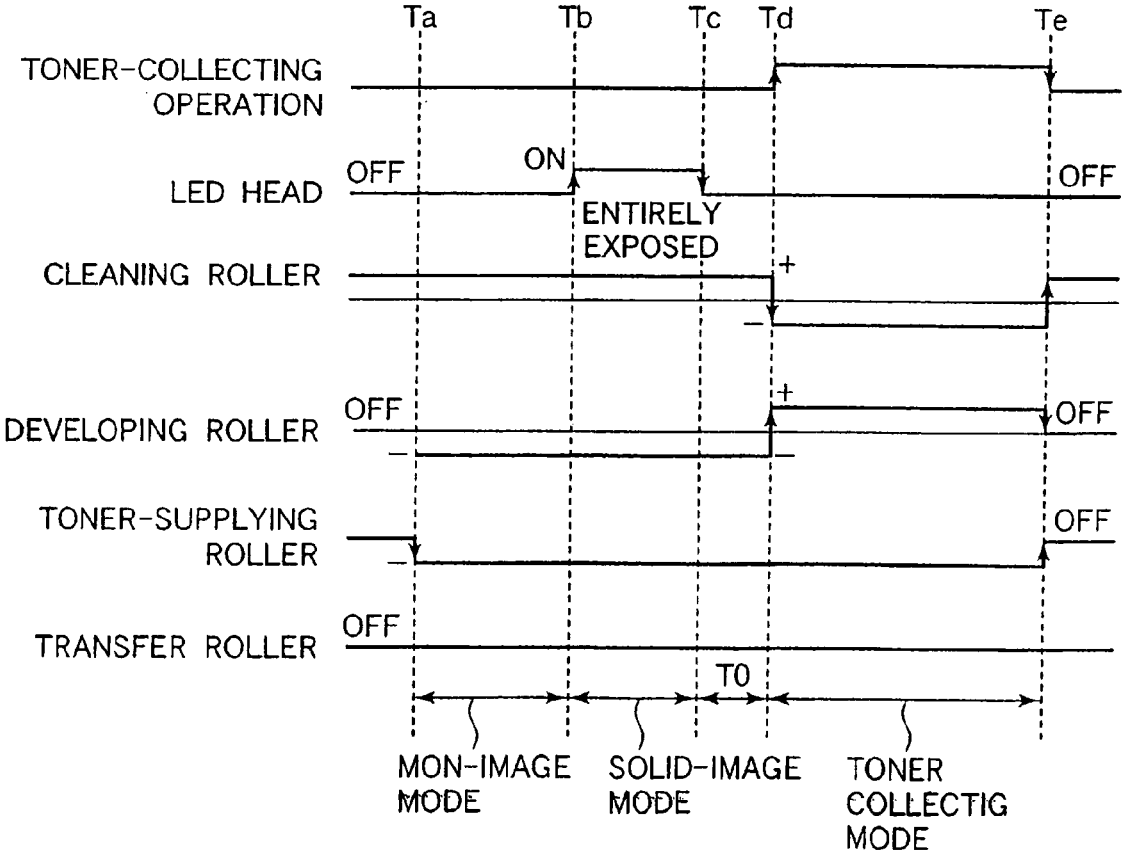
FIG. 11 is a timing chart, illustrating the operation of the fifth embodiment.

FIG. 11 is a timing chart, illustrating the operation of the fifth embodiment.

Referring to FIG. 11, the image-forming apparatus operates in the non-image forming mode, then in the solid-image forming mode, and finally in a toner-collecting mode. The SB current and DB current are measured in the solid-image forming mode. Then, the LED head 26 is activated at timing Tb for performing the solid-image forming mode in which measurement of the SB current and DB current is performed and completed at timing Tc.

The bias voltage Vg for the developing roller 2 is set below the potential of the residual toner on the photoconductive drum 1 (timing Td) before the residual toner on the photoconductive drum 1 comes into contact with the developing roller 2 again at point A (FIG. 9). As a result, the toner on the photoconductive drum 1 migrates to the developing roller 2, so that the residual toner is collected into the EP cartridge 13. Then, the cleaning mode is completed and the bias voltage for the cleaning roller 7 is set to the positive voltage again (timing Te).

Referring to FIG. 11, a short period T0 is provided after completion of current measurement (timing Tc) and before the toner collecting mode, in order to reduce disturbance to the measurement of the SB current and DB current. If a sufficient time length is provided for the solid-image forming mode so that the current can be measured accurately, the time duration TO is not required.

In order to remove the residual toner on the photoconductive drum 1, a positive bias voltage is applied to the cleaning roller 7 during a normal printing operation. In the toner collecting mode, the bias voltage for the cleaning roller 7 is such that the surface of the cleaning roller 7 is higher than the toner potential. Thus, the residual toner is not attracted to the cleaning roller 7 but remains on the photoconductive drum at timing Td.

It takes sometime for the toner to migrate to the photoconductive drum 1 and then reach the cleaning roller 7. Therefore, the timing Ta at which the bias voltage for the cleaning roller 7 may be equal to timing Tb or timing Tc.

The bias voltage for the transfer roller 5 is maintained off or higher than the potential of toner to be transferred during the current-measuring period, the time duration TO, and the toner collecting mode, thereby preventing the toner on the photoconductive drum 1 from migrating to the transfer roller 5.

According to the fifth embodiment, the respective bias voltages are controlled so that the toner used during the current measurement is collected into the EP cartridge 13. Thus, in addition to the advantages of the other embodiments, the fifth embodiment prevents waste of toner and provides excellent economic advantages.

Modifications

First Modification

The toner potential near the developing roller 2 is estimated based on the SB current in the first embodiment, the DSB current in the second embodiment, and the DB current in the fourth embodiment. Then, the bias voltage Ve for the charging roller 4 is set or corrected based on the estimated toner potential. As described with reference to FIG. 4, the migration of the toner 9 to the photoconductive drum 1 depends on the relation between the toner potential determined by the surface potential Vd and any one of the bias voltages Vg and Vs. Thus, the bias voltage Ve for the charging roller 4 may be fixed and the bias voltage for the developing roller 2 or the toner-supplying roller 3 may be corrected.

The first, second and fourth embodiments may be modified as follows:

If the sum of the estimated toner potential and the bias voltage for the developing roller 2 exceeds the surface potential Vd by a predetermined value, the bias voltage for the developing roller 2 or the toner-supplying roller 3 is lowered by a predetermined value, thereby lowering the toner potential. Conversely, if the surface potential Vd exceeds the sum of estimated toner potential and the bias voltage Vg for the developing roller by a predetermined value, then the bias voltage Vg or Vs may be raised by a predetermined value, thereby raising the toner potential.

It is known that soiling of the print medium or the surface of the photoconductive drum does not occur if the difference between Vd and the sum of Vg and Vt is in the range of −200 V to −450 V. Therefore, if Vd=−800 V and Vg=−300 V, the soiling of the print medium or the surface of the photoconductive drum can be prevented by selecting the voltages such that Vt=Vd−Vg−(−200 to −450)=−300 to −50 V.

Good print results cannot be obtained if the toner potential of a toner layer formed on the developing roller 2 falls out of the range of −50 to −300 V due to temperature and humidity changes caused by changes in the charging characteristic of toner. For example, if the DB current in FIG. 10 (fourth embodiment) is not more than 2 μA or not less than 9 μA, the estimated toner potential falls out of the range of −500 to −300 V. Therefore, good print results cannot be obtained. To solve this problem, if the DB current is not more than 2 μA, the bias voltage Vs for the toner-supplying roller 3 is raised. This prompts the charging and supply of the toner, so that the toner potential of the toner layer formed on the developing roller 2 is raised and the toner potential can be in the range of −50 to −300 V accordingly.

Conversely, if the DB current is not less than 9 μA, the bias voltage Vs for the toner-supplying roller 3 is lowered. This reduces the charging and supply of the toner, so that the toner potential of the toner layer formed on the developing roller 2 can be lowered and therefore the toner potential can be in the range of −50 to −300 V accordingly.

Figures 12, 13:
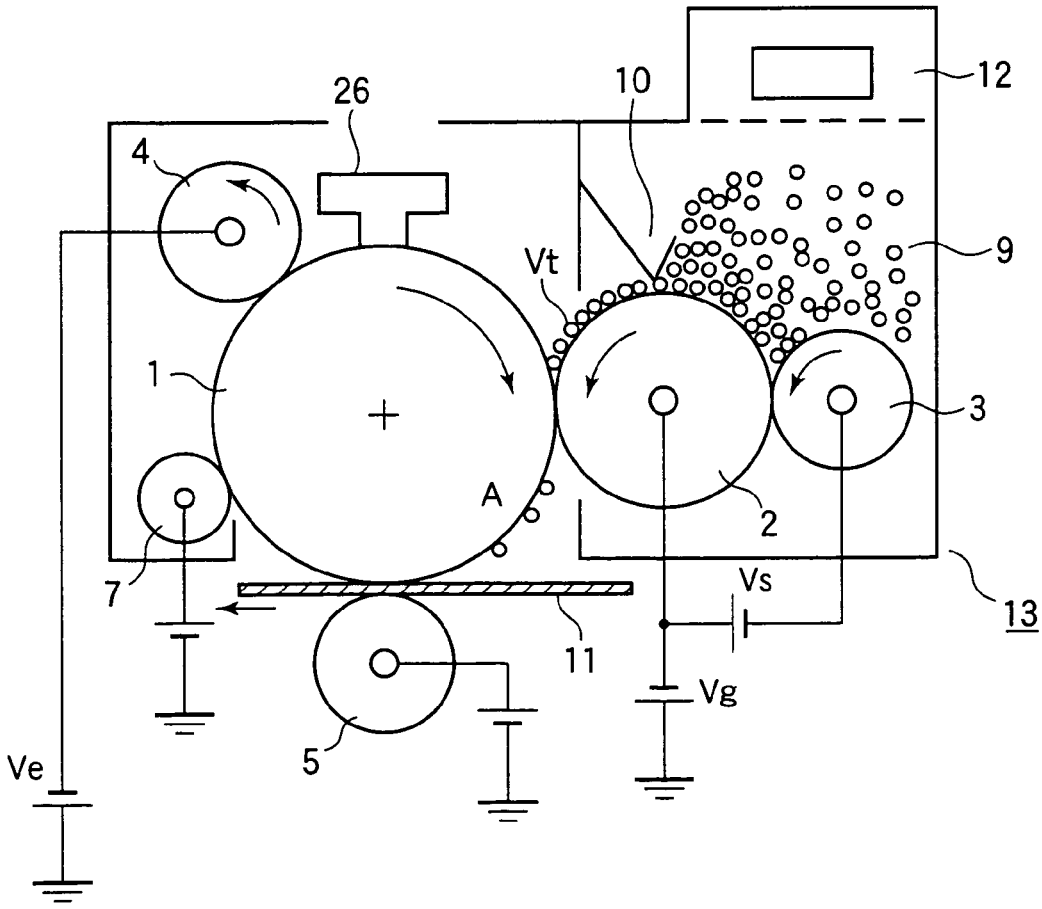
FIG.13 CONVENTIONAL ART
FIG. 12 illustrates SB currents and corresponding estimated toner potentials in a first modification.
FIG. 13 illustrates a general configuration of a conventional image-forming apparatus.

FIG. 12 illustrates SB currents and corresponding estimated toner potentials in a first modification.

For performing the aforementioned operation, the controller may have a table as shown in FIG. 12 so as to set the bias voltage Vs for the toner-supplying roller 3.

Likewise, the third embodiment may be modified as follows: When an SB current is not smaller than a predetermined value, the toner potential is too high and therefore the bias voltage for the developing roller 2 or the toner-supplying roller 3 is lowered, thereby lowering the toner potential.

In the correction of the bias voltages according to the aforementioned first modification, instead of correcting either the bias voltage for the developing roller 2 or the toner-supplying roller 3, the bias voltages for the developing roller 2 and the toner-supplying roller 3 may be corrected simultaneously by predetermined values. The correction of the bias voltages according to the aforementioned modification was described with respect to a case where the bias voltage Ve for the charging roller 4. Instead, the bias voltage Vg for the developing roller 2, the bias voltage Vt for the toner-supplying roller 3, and the bias voltage Ve for the charging roller 4 may be corrected simultaneously by predetermined values.

Second Modification

In the first, second, and fourth embodiments, the average value Vtave of toner potential is determined and the bias voltage Ve for the charging roller 4 is set based on the Vtave.

The first, second, and fourth embodiments may be modified as follows: The bias voltage Ve may be set in accordance with a minimum value Vtmin or a maximum value Vtmax of toner potential instead of the average value. For example, if the bias voltage Ve is set based on Vtmin, the bias voltage Ve may be set by the following equations, $$Ve = Vd\min + V\alpha \quad \text{Eq. (13)}$$

$$Vd\min = Vg + Vt\min + Va1 \quad \text{Eq. (14)}$$

where Va1 is about 600 V.

If the bias voltage Ve is set based on Vtmax, the bias voltage Ve may be set by $$Ve = Vd\max + V\alpha \quad \text{Eq. (15)}$$

$$Vd\max = Vg + Vt\max + Va2 \quad \text{Eq. (16)}$$

Just like the first modification, the bias voltage Ve may be fixed, and the bias voltage Vg for the developing roller 2 and the bias voltage Vs for the toner-supplying roller 3 may be corrected by predetermined values.

Third Modification

The embodiments of the invention have been described with respect to the respective bias voltages determined based on the SB current, DSB current, or DDB current, which are measured prior to a printing operation. Alternatively, the bias voltages may be set or corrected on a page-to-page basis or may be set before shipment of the apparatus from the factory. Still alternatively, the bias voltages may be set or corrected shortly after the apparatus is turned on, at predetermined time intervals while the apparatus remains turned on, or shortly after the toner cartridge is replaced.

Fourth Modification

In the first embodiment, the toner potential of the toner near or surrounding the developing roller 2 is estimated based on the SB current measured in the non-image forming mode, and then, the bias Ve for the charging roller 4 is set or corrected based on the estimated toner potential. Alternatively, the toner potential of the toner near the developing roller 2 may be estimated based on the SB current in the solid-image forming mode and the bias Ve for the charging roller 4 may be set or corrected based on the estimated toner potential.

Fifth Modification

In the third embodiment, when the SB current It exceeds the Itz by a predetermined value, the bias voltage Ve of the charging roller 4 is corrected. Alternatively, the third embodiment may be modified as follows: That is, when the DB current Idt described in the fourth embodiment exceeds a certain value, the bias voltage Ve for the charging roller 4 may be corrected.

When the sum of Vt and Vg exceeds Vd, soiling of print medium begins to occur. The SB current It or DB current Idt may be measured at all times or as required in the non-image forming mode, thereby estimating the toner potential from the measured SB current or DB current. If the estimated toner potential Vt is higher than the surface potential Vd, it may be determined that the bias voltage Ve for the charging roller 4 is too low, and therefore the bias voltage Ve may be decreased by a predetermined value.

Alternatively, just as in the first modification, instead of correcting the bias voltage Ve for the charging roller 4, the bias voltage Vg for the developing roller 2 and the bias voltage Vs for the toner-supplying roller 3 may be corrected by a predetermined value, thereby lowering the toner potential.

Sixth Modification

The embodiments have been described with respect to a case where the toner potential is estimated based on the SB current or the DB current. Instead, the image-forming apparatus may be configured such that both the SB current and DB current can be measured simultaneously or sequentially, and the bias voltage for the developing roller 2, toner-supplying roller, or the charging roller 4 is controlled based on the measured values of SB current and DB current.

Seventh Modification

The embodiments of the invention have been described with respect to a case where the bias voltage for the developing roller 2, toner-supplying roller 3, or charging roller 4 is controlled based on the values of the SB current or DB current in the solid-image forming mode. Instead, the SB current and DB current may be measured by performing a partial printing, i.e., in a mode between the solid-image forming mode and the non-image forming mode. Then, various sections may be controlled based on the measured SB current and DB current.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus comprising:

a photoconductive body on which an electrostatic latent image can be formed;

a developing member that causes developer to adhere to the electrostatic latent image to develop the electrostatic latent image;

a developer-supplying member that supplies the developer to said developing member;

a current measuring section that measures a current flowing through said developing member, the current being measured in timed relation with the development of the electrostatic latent image; and a voltage-setting section that sets said developer-supplying member to a corresponding one of first voltages, the corresponding one of first voltages being set in accordance with the current.

2. The apparatus according to claim 1, wherein said current measuring section measures the current in at least one of a non-image forming mode where the electrostatic latent image is not formed on said photoconductive body and a solid-image forming mode where a solid electrostatic latent image is formed on a substantially entire surface of said photoconductive body.

3. An image forming apparatus comprising:

a photoconductive body on which an electrostatic latent image can be formed;

a developing member that causes developer to adhere to the electrostatic latent image to develop the electrostatic latent image;

a developer-supplying member that supplies the developer to said developing member;

a current measuring section that measures a current flowing through at least one of said developing member and said developer-supplying member; and a voltage-setting section that sets at least one of said developing member and said developer-supplying member to a corresponding one of first voltages, the corresponding one of the first voltages being set in accordance with the current, wherein said current measuring section measures the current both in a non-image forming mode where the electrostatic latent image is not formed on said photoconductive body and a solid-image forming mode where a solid electrostatic latent image is formed on a substantially entire surface of said photoconductive body, the current being measured in timed relation with the development of the electrostatic latent image.

4. The apparatus according to claim 3, wherein said voltage-setting section sets the corresponding one of the first voltages based on a difference in the current between the non-image forming mode and the solid-image forming mode.

5. An image forming apparatus comprising:

a photoconductive body including a surface on which an electrostatic latent image is formed;

a charging member that charges the surface of said photoconductive body;

a developing member that causes developer to adhere to the electrostatic latent image to develop the electrostatic latent image;

a developer-supplying member that supplies the developer to said developing member;

a current measuring section that measures a current flowing through said developer-supplying member; and a voltage-setting section that sets said charging member to a voltage in accordance with the current.

6. The apparatus according to claim 5, wherein the current is measured in a non-image forming mode; and wherein when the current is larger than a predetermined value, said voltage-setting section increases an absolute value of the voltage supplied to said charging member by a predetermined first value.

7. The apparatus according to claim 5, wherein the current is measured in a non-image forming mode; and wherein when the current is larger than a predetermined value, said voltage-setting section either increases an absolute value of the voltage supplied to said charging member by a predetermined first value or decreases by a predetermined second value an absolute value of the voltage supplied to said developer-supplying member.

8. An image forming apparatus comprising:

a photoconductive body including a surface on which an electrostatic latent image is formed;

a charging member that charges the surface of said photoconductive body;

a developing member that causes developer to adhere to the electrostatic latent image to develop the electrostatic latent image;

a developer-supplying member that supplies the developer to said developing member;

a current measuring section that measures a current flowing through said developing member, the current being measured in timed relation with the development of the electrostatic latent image only when the electrostatic latent image has a reference pattern; and a voltage-setting section that sets said charging member to a voltage in accordance with the current.

9. The apparatus according to claim 8, wherein the current is measured in a non-image forming mode; and wherein when the current is larger than a predetermined value, said voltage-setting section increases an absolute value of the voltage supplied to said charging member by a predetermined first value.

10. The apparatus according to claim 8, wherein the current is measured in a non-image forming mode; and wherein when the current is larger than a predetermined value, said voltage-setting section either increases an absolute value of the voltage supplied to said charging member by a predetermined first value or decreases by a predetermined second value an absolute value of the voltage supplied to said developing member.

11. An image forming apparatus comprising:

a photoconductive body including a surface on which an electrostatic latent image is formed;

a charging member that charges the surface of said photoconductive body;

a developing member that causes developer to adhere to the electrostatic latent image to develop the electrostatic latent image;

a developer-supplying member that supplies the developer to said developing member;

a current measuring section that measures a current flowing through at least one of said developing member and said developer-supplying member, the current being measured in timed relation with the development of the electrostatic latent image only when the electrostatic latent image has a reference pattern; and a voltage-setting section that sets said charging member to a voltage in accordance with the current.

12. The apparatus according to claim 11, wherein the current is a current flowing through said developing member and is measured in a non-image forming mode; and wherein when the current is larger than a predetermined value, said voltage-setting section increases an absolute value of the voltage supplied to said charging member by a predetermined first value.

13. The apparatus according to claim 11, wherein said current measuring section measures at least one of a first current that flows through said developing member and a second current that flows through said developer-supplying member, the first current and the second current being measured in a non-image forming mode; and wherein when at least one of the first current and the second current is larger than a predetermined value, said voltage-setting section either increases an absolute value of the voltage supplied to said charging member by a predetermined first value or decreases by a predetermined second value an absolute value of the voltage supplied to said developing member.

* * * * *